US006029913A

United States Patent [19]

Stroia et al.

[11] Patent Number: 6,029,913

[45] Date of Patent: Feb. 29, 2000

[54] SWIRL TIP INJECTOR NOZZLE

[75] Inventors: Bradlee J. Stroia; Dennis M. Ashwill, both of Columbus; Chad L. Buchanan, Westport, all of Ind.

[73] Assignee: Cummins Engine Company, Inc., Columbus, Ind.

[21] Appl. No.: 09/144,970

[22] Filed: Sep. 1, 1998

[51] Int. Cl.[7] ..... F02M 61/16

[52] U.S. Cl. ..... 239/533.12; 239/533.2; 239/533.3

[58] Field of Search ..... 239/461, 533.2, 239/533.3, 533.4, 533.5, 533.8, 533.12, 533.15

[56] References Cited

U.S. PATENT DOCUMENTS

| | | | |
|---|---|---|---|
| 4,087,050 | 5/1978 | Tsuji et al. . | |
| 4,360,161 | 11/1982 | Claxton et al. . | |
| 4,413,780 | 11/1983 | Skinner et al. . | |
| 4,434,766 | 3/1984 | Matsuoka et al. . | |
| 4,465,231 | 8/1984 | Sharp | 239/533.5 X |
| 4,805,837 | 2/1989 | Brooks et al. . | |
| 4,907,746 | 3/1990 | Aichele et al. . | |
| 4,955,326 | 9/1990 | Helmich | 123/27 GE |
| 4,971,254 | 11/1990 | Daly et al. . | |
| 5,018,501 | 5/1991 | Watanabe et al. . | |
| 5,029,759 | 7/1991 | Weber | 239/533.12 |
| 5,058,810 | 10/1991 | Bonfiglioli et al. . | |
| 5,109,824 | 5/1992 | Okamoto et al. . | |
| 5,156,130 | 10/1992 | Soma . | |
| 5,232,163 | 8/1993 | Grytz . | |
| 5,263,645 | 11/1993 | Paul et al. . | |
| 5,271,563 | 12/1993 | Cerny et al. . | |
| 5,326,034 | 7/1994 | Peters . | |
| 5,353,992 | 10/1994 | Regueiro . | |

FOREIGN PATENT DOCUMENTS

| | | |
|---|---|---|
| 1301955 | 12/1989 | Japan . |
| 2096702 | 10/1982 | United Kingdom . |

*Primary Examiner*—David J. Walczak
*Assistant Examiner*—Kathleen J. Prunner
*Attorney, Agent, or Firm*—Sixbey, Friedman Leedom & Ferguson PC; Charles M. Leedom, Jr.; Tim L. Brackett Jr.

[57] ABSTRACT

A swirl tip injector nozzle housing is provided for a fuel injector which includes a fuel atomization enhancing feature for creating effective fuel atomization and breakup during discharge from the injector. The fuel atomization enhancing feature includes a plurality of curvilinear spray holes having an angle of curvature equal to approximately 90 degrees. Fuel flowing from the inlet of each spray hole to the outlet is induced, by the 90 degree angle of curvature, to flow through a tangential flow path or swirl within the spray hole causing rapid spreading and breakup of the fuel jet spray upon exiting the outlet of the spray hole. The fuel atomization enhancing feature may also include positioning each spray hole so as to extend orthogonally from the interior surface of the fuel cavity to create optimal entry of the fuel into the tangential flow path.

15 Claims, 1 Drawing Sheet

SWIRL TIP INJECTOR NOZZLE

TECHNICAL FIELD

The present invention relates to a fuel injector nozzle assembly including nozzle spray holes capable of effectively producing a swirl flow of fuel within each spray hole for increasing atomization and fuel/air mixing.

BACKGROUND OF THE INVENTION

In most fuel supply systems applicable to internal combustion engines, fuel injectors are used to direct fuel pulses into the engine combustion chamber. Combustion of the fuel in the chamber is improved through effective atomization of the fuel spray and mixing of the fuel and air. One way of achieving increased atomization and mixing is to increase the pressure of the fuel being injected. However, the increased injection pressure capability requires a fuel system to be more robust to operate reliably and safely at the increased pressures thereby undesirably resulting in additional costs.

Another manner of creating increased atomization and fuel/air mixing is to design the nozzle spray holes of the injector to create a turbulent spray pattern. U.S. Pat. No. 5,263,645 issued to Paul et al. discloses a fuel injector nozzle including multiple spray holes formed in a nozzle housing and tangentially oriented relative to a conical interior wall of the nozzle. This spray hole arrangement causes the discharged fuel to swirl and generate a turbulent spray pattern in each hole. However, manufacturing of the spray holes to achieve the tangential positioning is difficult resulting in increased costs.

U.S. Pat. No. 5,029,759 issued to Weber discloses a fuel injector including curved spray holes extending through a nozzle wall. However, the curved spray holes intersect the nozzle cavity interior wall at an angle to ensure smooth, nonturbulent flow through the hole. Also, the spray holes have only a limited angle of curvature.

Consequently, there is a need for a fuel injector including a nozzle assembly having multiple spray holes capable of enhancing fuel atomization and fuel/air mixing.

SUMMARY OF THE INVENTION

It is a primary object of the present invention to overcome the disadvantages of the prior art and to provide a fuel injector having a nozzle assembly which improves fuel atomization and fuel/air mixing.

Another object of the present invention is to provide a nozzle assembly capable of achieving proper fuel atomization at lower fuel pressures than existing fuel systems.

Still another object of the present invention is to provide a fuel injector which minimizes the cost and complexity of the entire fuel system.

Yet another object of the present invention is to provide a fuel injector capable of ultimately reducing emissions from the combustion process.

These and other objects of the present invention are achieved by providing a nozzle housing for a fuel injector capable of periodically injecting fuel into the combustion chamber of an internal combustion engine, comprising a nozzle housing body including a nozzle wall having an interior surface and an exterior surface, and a fuel cavity formed by the interior surface for receiving fuel prior to injection. The nozzle housing also includes a fuel atomization enhancing feature for enhancing atomization of fuel in the combustion chamber of the engine. The fuel atomization enhancing feature includes a plurality of curvilinear spray holes formed in the nozzle wall immediately downstream of the fuel cavity and extending outwardly through the nozzle wall for directing fuel outwardly from the fuel cavity into the combustion chamber. Each of the plurality of curvilinear spray holes are curvilinear throughout its length between the interior surface and the exterior surface of the nozzle wall. Each of the plurality of curvilinear spray holes may include a curvilinear longitudinal axis extending through an angle of curvature of approximately 90 degrees. The curvilinear longitudinal axis of each of the plurality of curvilinear spray holes may extend. orthogonally from an extension of the interior surface of the nozzle wall. The plurality of curvilinear spray holes may also extend in a common circular direction around the central axis of the nozzle housing and may include at least six spray holes. The nozzle housing is preferably used as a component of a fuel injector body adapted to receive fuel.

DETAILED DESCRIPTION OF THE PREFERRED EMBODIMENT

Figure 1:
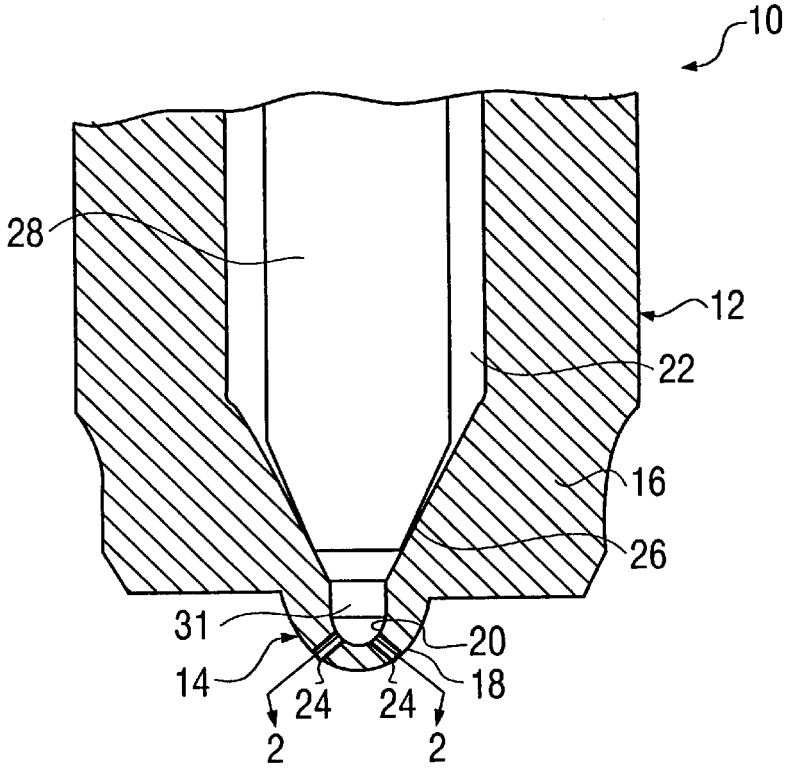
FIG. 1 is a cross sectional view of the fuel injector nozzle housing of the present invention including a nozzle valve element.

Referring to FIG. 1, there is shown a lower portion of a fuel injector indicated generally at 10, which includes a nozzle housing 12 of the present invention. Nozzle housing 12 includes a fuel atomization enhancing feature, indicated generally at 14, as described more fully hereinbelow, designed to effectively increase fuel atomization within the combustion chamber of an internal combustion engine thereby improving the fuel/air mixing process. Nozzle housing 12 includes a nozzle wall 16 having an exterior surface 18 and an interior surface 20 forming a fuel cavity 22 for receiving fuel for injection into the engine combustion chamber.

Fuel atomization enhancing feature 14 includes a plurality of curvilinear spray holes 24 formed in the lower end of nozzle wall 16 and extending outwardly from fuel cavity 22 to communicate with a combustion chamber (not shown) of the engine when the fuel injector 10 is mounted in a mounting bore formed in the engine overhead. Although the preferred embodiment includes six spray holes, any number of spray holes may be used depending on the spray pattern desired. As described more fully hereinbelow, curvilinear spray holes 24 function to more effectively create a swirling flow of fuel within each spray hole 24 resulting in improved atomization of the fuel upon exiting spray holes 24. Nozzle housing 12 also includes a valve seat 26. Fuel injector 10 includes a nozzle valve element 28 mounted in fuel cavity 22 for reciprocal movement between a closed position against valve seat 26 blocking fuel flow from fuel cavity 22 through spray holes 24 and an open position permitting fuel flow from fuel cavity 22 into the combustion chamber via spray holes 24.

As shown in FIG. 1, nozzle valve element 28 may be a conventional spring-biased closed nozzle valve element pressure actuated by fuel pressure in fuel cavity 22, such as disclosed in U.S. Pat. No. 5,326,034, the entire contents of which is hereby incorporated by reference. However, the nozzle housing 12 and fuel atomization enhancing feature 14 of the present invention can be adapted for use with a variety of injectors and, therefore, is not limited to the injector disclosed in FIG. 1. For instance, although FIG. 1 suggests a sac type injector having a volume of fuel downstream of the valve seat 26, a valve closed orifice (VCO) nozzle type may be used wherein the nozzle valve element covers the spray holes 24. Also, nozzle housing 12 and fuel atomization enhancing feature 14 may be incorporated into open and closed nozzle type fuel injectors. In addition, nozzle housing 12 and fuel atomization enhancing feature 14 may be used in conjunction with any type of unit injector having a high pressure pump plunger incorporated into the injector and/or an injector including an electronically actuated nozzle valve element.

Figure 2:
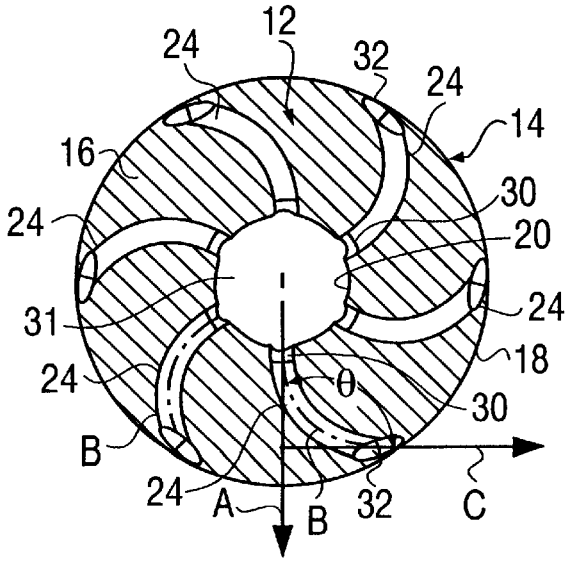
FIG. 2 is a cross sectional view of the curvilinear spray holes of the fuel atomization enhancing means of the present invention taken along plane 2—2 in FIG. 1.
Figure 3:
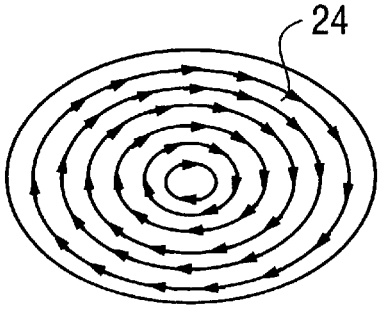
FIG. 3 is a cross sectional view of one of the curvilinear spray holes showing the tangential velocity vectors or flow within the spray hole.

Referring to FIG. 2, fuel atomization enhancing feature 14 includes curvilinear spray holes 24 having a predetermined angle of curvature θ. Specifically, curvilinear spray holes 24 are designed so as to extend through an angle of curvature θ equal to approximately 90 degrees. In the preferred embodiment, curvilinear spray holes 24 extend on a common circular direction around a central axis of the nozzle housing 12. As shown in FIG. 2, an inlet 30 of each spray hole 24 connects to a sac 31 of fuel cavity 22 so as to direct fuel into spray hole 24 initially along the direction of vector A. Each spray hole 24 is curvilinear along its entire length and includes a curvilinear longitudinal axis B extending through the angle of curvature θ equal to approximately 90 degrees. Also, each spray hole 24 includes an outlet 32 formed at an opposite end from inlet 30 which communicates with the engine combustion chamber. Fuel flows from outlet 32 in the direction of a vector C which is positioned at approximately the angle of curvature 90 degrees from vector A. Therefore, fundamentally, each spray hole 24 is machined to transcend a 90 degree bend before it exits nozzle wall 16. Applicants have found that an angle of curvature or bend equal to approximately 90 degrees, induces a tangential flow or swirl within the spray hole due to conservation of momentum as shown in FIG. 3. The fuel flow represented by tangential velocity vectors of FIG. 3 extend in a spiral, tangential fashion through spray holes 24 between inlet 30 and outlet 32. This tangential flow increases spray atomization and droplet breakup as the fuel flow exits each spray hole 24. This swirling effect within each hole causes greater fuel droplet breakup and atomization since upon exit from the hole the constraints of the hole wall will be removed allowing the swirling momentum to optimally create a rapid spreading and breakup of the spray jet of fuel.

Thus, during operation, when nozzle valve element 28 moves from the closed position shown in FIG. 1 to an open position, fuel flows from fuel cavity 22 and thus sac 31 into the inlet 30 of each spray hole 24. The fuel begins to move longitudinally through spray hole 24 while following a tangential flow path creating a swirling flow of fuel due to conservation of momentum caused by the approximately 90 degree angle of curvature θ. The spiraling fuel flow exits each spray hole 24 via outlet 32 and begins to effectively atomize by more effectively spreading out due to the tangential swirling flow.

Fuel atomization enhancing feature 14 also includes positioning spray hole 24, and specifically inlet 30, so that vector A extends orthogonally from interior surface 20 of nozzle wall 16. Thus, spray holes 24 are machined so as to intersect sac 31 perpendicular to the interior surface 20 of sac 31. This orthogonal intersection between spray holes 24 and sac 31 causes optimal fuel flow into spray holes 24 while permitting the angle of curvature θ to effectively create the atomization desired.

Thus, nozzle housing 12 including fuel atomization enhancing feature 14 results in distinct advantages over conventional nozzle housing and spray hole designs. First, spray holes 24 function to more effectively atomize and breakup the fuel spray upon exiting the spray holes by creating a tangential flow or swirl within each spray hole thereby improving combustion and reducing emissions. Secondly, as a result of the improved atomization, the associated fuel system may be operated at a lower pressure than otherwise necessary to achieve the proper atomization. Consequently, the fuel injection system need not be designed and assembled to handle such higher pressures thereby reducing overall costs. Third, spray holes 24 achieve improved atomization while avoiding increased manufacturing costs due to the easy manufacturability of spray holes 24. For instance, spray holes 24 may be inexpensively formed by electrical discharge machining using an EDM electrode in the shape of a constant pitch helix having a radius of curvature necessary to achieve an angle of curvature θ of approximately 90 degrees.

Industrial Applicability

The present invention is applicable to all fuel injectors used to inject fuel into any type of internal combustion engine. This invention is particularly applicable to diesel engines which require enhanced atomization in order to minimize emissions and optimize combustion. Such internal combustion engines including a fuel injector having a nozzle assembly in accordance with the present invention can be widely used in all industrial fields and non-commercial applications, including trucks, passenger cars, industrial equipment, stationary power plant and others.

We claim:

1. A nozzle housing for a fuel injector capable of periodically injecting fuel into the combustion chamber of an internal combustion engine, comprising:

a nozzle housing body including a nozzle wall having an interior surface and an exterior surface, and a fuel cavity formed by said interior surface for receiving fuel prior to injection;

fuel atomization enhancing means for enhancing atomization of fuel in the combustion chamber of the engine, said fuel atomization enhancing means including a plurality of curvilinear spray holes formed in said nozzle wall immediately downstream of said fuel cavity and extending outwardly through said nozzle wall for directing fuel outwardly from said fuel cavity into the combustion chamber, each of said plurality of curvilinear spray holes being curvilinear throughout its length between said interior surface and said exterior surface of said nozzle wall, wherein each of said plurality of curvilinear spray holes includes an inlet having an inlet axis and an outlet having an outlet axis positioned approximately 90 degrees relative to said inlet axis to define an angle of curvature of approximately 90 degrees, each of said plurality of curvilinear spray holes including a curvilinear longitudinal axis extending through said angle of curvature of approximately 90 degrees.

2. The nozzle housing of claim 1, wherein said curvilinear longitudinal axis of each of said plurality of curvilinear spray holes extends orthogonally from an extension of said interior surface of said nozzle wall.

3. The nozzle housing of claim 1, wherein said plurality of curvilinear spray holes extend in a common circular direction around a central axis of said nozzle housing.

4. The nozzle housing of claim 1, wherein said plurality of curvilinear spray holes includes at least six spray holes.

5. A nozzle housing for a fuel injector capable of periodically injecting fuel into the combustion chamber of an internal combustion engine, comprising:

a nozzle housing body including a nozzle wall having an interior surface and an exterior surface, and a fuel cavity formed by said interior surface for receiving fuel prior to injection;

fuel atomization enhancing means for enhancing atomization of fuel in the combustion chamber of the engine, said fuel atomization enhancing means including a plurality of curvilinear spray holes formed in said nozzle wall immediately downstream of said fuel cavity and extending outwardly through said nozzle wall for directing fuel outwardly from said fuel cavity into the combustion chamber, each of said plurality of curvilinear spray holes being curvilinear throughout its length between said interior surface and said exterior surface of said nozzle wall, wherein each of said plurality of curvilinear spray holes includes a curvilinear longitudinal axis extending orthogonally from an extension of said interior surface of said nozzle wall.

6. The nozzle housing of claim 5, wherein said curvilinear longitudinal axis of each of said plurality of curvilinear spray holes extends through an angle of curvature of approximately 90 degrees.

7. The nozzle housing of claim 5, wherein said plurality of curvilinear spray holes extend in a common circular direction around a central axis of said nozzle housing.

8. The nozzle housing of claim 7, wherein said plurality of curvilinear spray holes includes at least six spray holes.

9. A fuel injector for periodically injecting fuel into the combustion chamber of an internal combustion engine, comprising:

an injector body adapted to receive fuel and including a nozzle housing body including a nozzle wall having an interior surface and an exterior surface, and a fuel cavity formed by said interior surface for receiving fuel prior to injection;

fuel atomization enhancing means for enhancing atomization of fuel in the combustion chamber of the engine, said fuel atomization enhancing means including a plurality of curvilinear spray holes formed in said nozzle wall immediately downstream of said fuel cavity and extending outwardly through said nozzle wall for directing fuel outwardly from said fuel cavity into the combustion chamber, each of said plurality of curvilinear spray holes being curvilinear throughout its length between said interior surface and said exterior surface of said nozzle wall, wherein each of said plurality of curvilinear spray holes includes a curvilinear longitudinal axis extending orthogonally from an extension of said interior surface of said nozzle wall.

10. The fuel injector of claim 9, wherein said curvilinear longitudinal axis of each of said plurality of curvilinear spray holes extends through an angle of curvature of approximately 90 degrees.

11. The fuel injector of claim 9, wherein said plurality of curvilinear spray holes extend in a common circular direction around a central axis of said nozzle housing.

12. The fuel injector of claim 11, wherein said plurality of curvilinear spray holes includes at least six spray holes.

13. A fuel injector for periodically injecting fuel into the combustion chamber of an internal combustion engine, comprising:

an injector body adapted to receive fuel and including a nozzle housing body including a nozzle wall having an interior surface and an exterior surface, and a fuel cavity formed by said interior surface for receiving fuel prior to injection;

fuel atomization enhancing means for enhancing atomization of fuel in the combustion chamber of the engine, said fuel atomization enhancing means including a plurality of curvilinear spray holes formed in said nozzle wall immediately downstream of said fuel cavity and extending outwardly through said nozzle wall for directing fuel outwardly from said fuel cavity into the combustion chamber, each of said plurality of curvilinear spray holes being curvilinear throughout its length between said interior surface and said exterior surface of said nozzle wall, wherein each of said plurality of curvilinear spray holes includes an inlet having an inlet axis and an outlet having an outlet axis positioned approximately 90 degrees relative to said inlet axis to define an angle of curvature of approximately 90 degrees, each of said plurality of curvilinear spray holes including a curvilinear longitudinal axis extending orthogonally from an extension of said interior surface of said nozzle wall extending said angle of curvature of approximately 90 degrees.

14. The fuel injector of claim 13, wherein said plurality of curvilinear spray holes extend in a common circular direction around a central axis of said nozzle housing.

15. The fuel injector of claim 14, wherein said plurality of curvilinear spray holes includes at least six spray holes.

* * * * *